United States Patent [19]

Yan

[11] 4,337,979

[45] Jul. 6, 1982

[54] PROCESS FOR THE IN-SITU LEACHING OF URANIUM

[75] Inventor: Tsoung-yuan Yan, Philadelphia, Pa.

[73] Assignee: Mobil Oil Corporation, New York, N.Y.

[21] Appl. No.: 36,890

[22] Filed: May 7, 1979

[51] Int. Cl.[3] ..... E21C 41/14

[52] U.S. Cl. ..... 299/4; 299/5

[58] Field of Search ..... 299/4, 5, 40 P; 423/15, 423/17, 18, 20

[56] References Cited

U.S. PATENT DOCUMENTS

| | | | |
|---|---|---|---|
| 2,954,218 | 9/1960 | Dew et al. | 299/4 |
| 3,309,141 | 3/1967 | Fitch | 299/4 |
| 3,713,698 | 1/1973 | Rhoades | 299/4 |
| 4,043,599 | 8/1977 | Lingane | 299/4 |
| 4,105,253 | 8/1978 | Showalter | 299/5 |

OTHER PUBLICATIONS

Merritt, R. C., *The Extractive Metallurgy of Uranium*, Colo. School of Mines, Research Institute, U.S.A., 1971 pp. 62, 63, 109–111.

*Primary Examiner*—William F. Pate, III

*Attorney, Agent, or Firm*—Charles A. Huggett; James F. Powers, Jr.; John K. AboKhair

[57] ABSTRACT

Process for the in-situ leaching of uranium from a subterranean ore deposit employing a lixiviant containing an oxidizing agent, sulfuric acid, and carbon dioxide. Prior to the injection of the lixiviant, an aqueous solution of sulfuric acid and oxidizing agent is injected into the deposit in an amount of at least 1 pore volume. The initially injected acid solution is substantially free of carbon dioxide. The process is particularly applicable to subterranean deposits containing uranium associated with carbonaceous material.

7 Claims, 2 Drawing Figures

PROCESS FOR THE IN-SITU LEACHING OF URANIUM

BACKGROUND OF THE INVENTION

The present invention relates to the recovery of uranium from subterranean ore deposits and more particularly to an in-situ leaching operation in which an aqueous lixiviant containing sulfuric acid and carbon dioxide is preceded by a sulfuric acid solution which is substantially free of carbon dioxide.

In an in-situ leaching operation, a lixiviant is introduced into a subterranean uranium ore deposit through a suitable injection system. The lixiviant may be an acidic or alkaline medium which solubilizes uranium values as it traverses the ore body. The pregnant lixiviant is then withdrawn from the ore body through a production system and treated to recover uranium therefrom by suitable techniques such as solvent extraction, direct precipitation, or by adsorption and elution employing an ion exchange resin.

In acid leaching operations, the most commonly employed acid is sulfuric acid. The sulfuric acid normally is present in the lixiviant in a concentration to provide a pH of 2 or less. Normally, sufficient acid is present in the lixiviant to provide an excess of acid over that consumed by uranium solubilization and inorganic carbonates within the formation in order to retain a relatively low pH in the pregnant lixiviant as it is withdrawn from the ore. For example, as disclosed in Merritt, R. C., THE EXTRACTIVE METALLURGY OF URANIUM, Colorado School of Mines, Research Institute, USA (1971), at pages 62 and 63, under the heading "Acid Concentration", it is desirable to provide excess acid in order to prevent reprecipitation of uranium. Thus, Merritt discloses that free acid concentrations of from 1 to 90 grams per liter (0.1 to 9 weight percent) may be required continuously during the contact period.

The presence of carbonate materials in subterranean rock deposits containing uranium limits the use of acid lixiviants not only with respect to acid consumption by the carbonates but also due to the precipitation of reaction products such as calcium sulfate which may result in plugging of the formation. For example, Merritt at pages 109–111 describes an in-situ leaching procedure employing sulfuric acid which utilizes the natural flow of ground water through the subterranean ore deposit as a containment shell for the leaching solution. Merritt states that when lime bearing materials (carbonates) are present, the usual practice is to start feeding the solution a low concentration of from 1.0 to 1.5 grams of $H_2SO_4$ per liter until acid is detected in the produced effluent. At this time, the lime in the formation is considered to have been neutralized and the acid concentration is increased in increments to a maximum of 5 grams per liter.

The use of sulfuric acid in in-situ leaching of uranium is also disclosed in U.S. Pat. No. 3,309,141 to Fitch et al. In this process, sufficient sulfuric acid is used to react with all the acid consuming materials in the ore body and yet leave a residual solution of not less than 0.005 molar $H_2SO_4$.

U.S. Pat. No. 4,043,599 to Lingane et al. discloses an in-situ leaching process in which an oxidant containing acid lixiviant is preceded by an oxidant free-acid solution to minimize acid consumption during the leaching operation. Both the preinjected acid solution and the lixiviant may contain sulfuric acid. The acid preinjection step eliminates or minimizes a substantial rise in pH value in the deposit during the oxidative leaching process. The process is particularly applicable to the recovery of copper values from an ore having a low pyrite to chalcopyrite ratio but is also disclosed for use in pitch blend deposits.

In many in-situ leaching operations, particularly where the subterranean ore body has a high carbonate content, carbonate lixiviants are employed. These lixiviants contain carbonate or bicarbonate ions or mixtures thereof which function to complex the uranium in the form of water-soluble uranyl carbonate ions. The carbonate lixiviants may be formulated by the addition of alkali metal or ammonium carbonates and/or bicarbonates or by the addition of carbon dioxide together, in most cases, with an alkaline agent, e.g. sodium hydroxide or ammonia, to control the pH. An in-situ leaching procedure in which the lixiviant contains carbonate and bicarbonate ions is disclosed in U.S. Pat. No. 4,105,253 to Showalter. In this process the injected lixiviant is a neutral or near-neutral solution of carbonic acid formulated by dissolving carbon dioxide in the injected water. The pH of the injected lixiviant is maintained within the range of 6 to 7 to provide a bicarbonate ion concentration between about 380 ppm and 1,000 ppm.

U.S. patent application Ser. No. 934,933 filed Aug. 18, 1978 by Edward Thomas Habib, Jr. discloses an in-situ leaching process which involves the injection of a near-neutral or alkaline lixiviant in which an alkali metal sulfate such as sodium sulfate is employed as a leaching agent. The pH of the lixiviant may range down to about 6 and the lixiviant may also containing minor amounts of alkali metal carbonates or bicarbonates.

SUMMARY OF THE INVENTION

In accordance with the present invention, there is provided a new and improved process for the recovery of uranium from a subterranean deposit which is leached with an aqueous lixiviant containing an oxidizing agent, sulfuric acid, and carbon dioxide. The improvement, in accordance with the present invention, involves prior to the injection of the sulfuric acid-carbon dioxide-oxidant lixiviant, injecting an aqueous solution of sulfuric acid which contains an oxidizing agent but which is substantially free of carbon dioxide. The preinjected acid solution is introduced into the deposit in an amount of at least 1 pore volume. Preferably the preinjected acid solution has a lower sulfuric acid concentration than that of the lixiviant. In a preferred embodiment of the invention, the preinjected acid solution has a pH within the range of 2–3 and the subsequently injected lixiviant has a pH within the range of 1.0–2.5.

In a further embodiment of the invention, the pH of the preinjected acid solution is monitored as it is recovered from the deposit through the production system and lixiviant injection is initiated when the pH of the produced solution declines to a value of less than 6.5. In yet a further embodiment, the uranium concentration of the produced acid solution is monitored and lixiviant injection is initiated when the uranium concentration of the produced acid solution reaches a level of at least 5 parts per million calculated as $U_3O_8$.

DESCRIPTION OF THE SPECIFIC EMBODIMENTS

Figure 1:
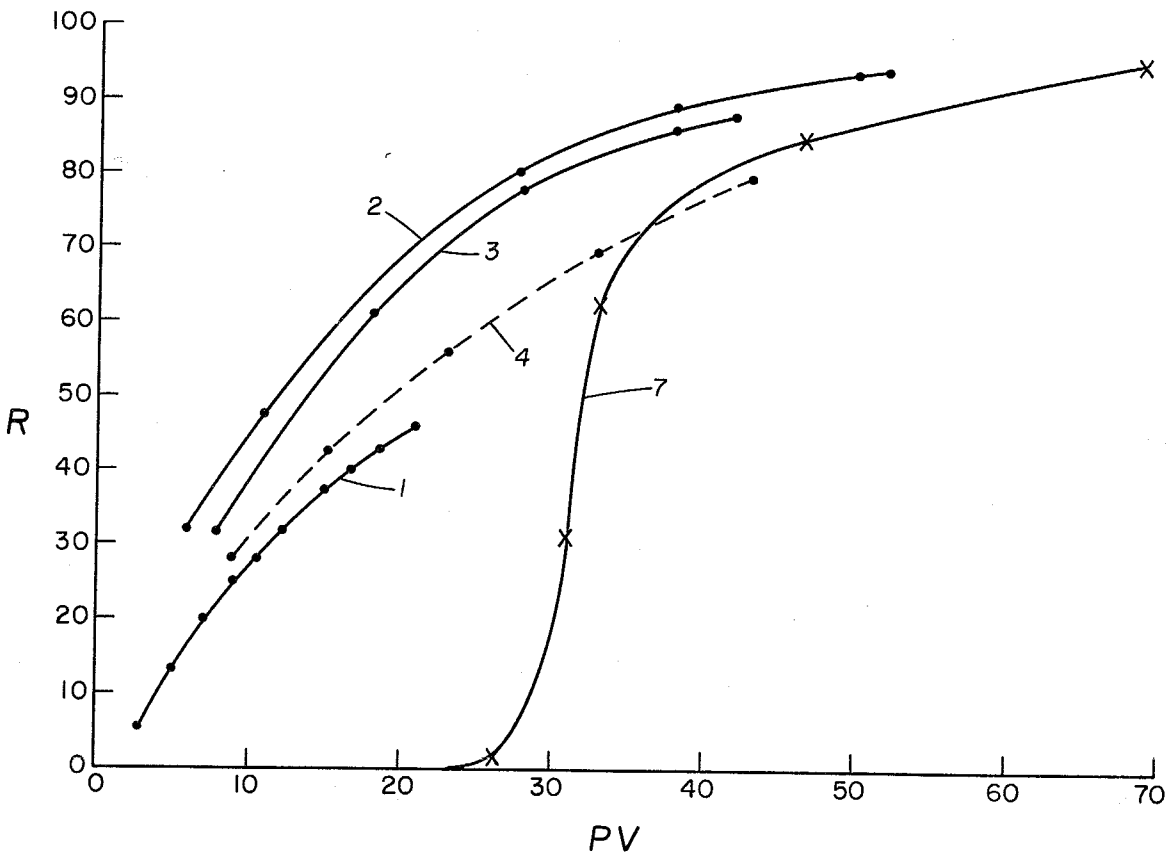
FIG. 1 is a graph illustrating uranium recovery achieved through the use of a carbon dioxide-sulfuric acid lixiviant preceded by the injection of a carbon dioxide-free sulfuric acid solution.

Some subterranean ore deposits which are refractory to near-neutral or alkaline lixiviants employing carbonate and/or bicarbonate ions as the leaching agent are more readily leached with an acid lixiviant employing sulfuric acid. However, in many cases, such deposits contain significant quantities of carbonate materials such as calcite which, as noted in the aforementioned material by Merritt, may lead to excessive acid consumption as well as plugging by precipitation of calcium sulfate. In U.S. patent application Ser. No. 36,627, filed May 7, 1979 by Wilton F. Espenscheid and Tsoung-yuan Yan entitled PROCESS FOR THE IN-SITU LEACHING OF URANIUM, there is disclosed an in-situ uranium leaching process employing a dilute solution of sulfuric acid which also contains carbon dioxide. The carbon dioxide in combination with sulfuric acid functions to increase the leaching rate and also the ultimate uranium recovery without excessive consumption of sulfuric acid. The lixiviant also contains in addition to the sulfuric acid and carbon dioxide a suitable oxidizing agent such as air, oxygen, hydrogen peroxide, or sodium chlorate. As will be understood by those skilled in the art, the oxidizing agent functions to oxidize the uranium from the insoluble tetravalent state to the soluble hexavalent state where it is complexed by the lixiviant. For a more detailed description of the uranium leaching process employing sulfuric acid and carbon dioxide, reference is made to the aforementioned patent application Ser. No. 36,627.

In the present invention, the lixiviant is preceded by at least 1 pore volume of a dilute sulfuric acid solution an an oxidizing agent. The oxidizing agent functions to oxidize the uranium in the formation to the hexavalent state as described previously but the sulfuric acid is a relatively poor complexing agent in comparison with the carbon dioxide and the subsequently injected lixiviant. Thus, the uranium in the subterranean formation is preoxidized but not readily mobilized and the uranium concentration in the produced effluent remains relatively low. After the injection of a suitable amount of acid solution, as may be determined by any one or more of several parameters as described hereinafter, injection of the sulfuric-carbon dioxide lixiviant is started.

In experimental work relative to the invention, leaching tests were carried out on samples of a composite ore obtained from different depths of the same core hole penetrating a subterranean uranium deposit. The ore contained uranium in the form of coffinite occurring as individual grains and aggregates of grains in a matrix of carbonaceous material. The matrix contains other minerals such as pyrite, apatite, anatase or rutile, and chlorite. The carbonaceous material occurs in a poorly sorted sandstone consisting of detrital quartz, feldspar and rock fragments. Locally abundant kaolinite or chlorite, calcite and the carbonaceous material are the primary cementing agents. The ore contained uranium in a concentration of 0.091 weight percent calculated as $U_3O_8$ and contained 0.12 weight percent of carbonaceous material calculated as organic carbon. The carbonate concentration of the ore was 1.193 weight percent calculated as calcium carbonate.

In the experimental work, high pressure column leaching tests were carried out. In this procedure, the uranium ore was packed into a vertical column having an internal diameter of $\frac{7}{8}''$ and a length of 30". The lixiviant was flowed upwardly through the column and recovered from the other end and then analyzed for its uranium content. In each case the lixiviant was pumped through the column at a flow rate of 0.5 pore volume per day.

In a first column leaching test, the lixiviant was formulated by the addition of 5 grams per liter of sulfuric acid, 74 grams per liter of sodium sulfate, and 1 gram per liter of sodium chloride to distilled water. Elemental oxygen was employed as the oxidizing agent and was dissolved in the lixiviant under a pressure of 800 psig. The results of this test are shown in FIG. 1 by curve 1 which is a plot of the percentage of uranium recovery, R, plotted on the ordinate versus the cumulative pore volumes, PV, of leaching solution injected plotted on the abscissa. As can be seen from an examination of curve 1, the percent uranium recovery had reached a value of about 46 percent when the test was terminated after the injection of 21 pore volumes of lixiviant.

In a second column leaching test, the lixiviant contained a lower amount of sulfuric acid (4 grams per liter) but in this case the lixiviant contained carbon dioxide under a partial pressure of 15 psig. The lixiviant was saturated with a slightly smaller amount of oxygen under a partial pressure of 785 psig. It contained the same concentration of sodium chloride (1 gram per liter) and sodium sulfate in a concentration of 15 grams per liter. The decreased sodium sulfate concentration is not considered to be of significance for comparative purposes since previous experimental work indicates that additional sodium sulfate in an amount above 5 to 10 grams per liter has little or no additional effect on uranium recovery. The results of this test are shown by curve 2 of FIG. 1. As illustrated, the addition of carbon dioxide resulted in a significantly higher leaching rate as indicated by the slope of the curve and also a significantly higher ultimate uranium recovery. At 21 pore volumes, the uranium recovery was about 70 percent and at 52 pore volumes, when the test was terminated, the uranium recovery was about 94 percent.

A third column test employing carbon dioxide was carried out with the same acid concentration (5 grams per liter) as in the first test but with a significantly lower concentration of oxidizing agent. In this case, the oxygen was dissolved in the lixiviant under a pressure of 385 psig. The carbon dioxide pressure was again 15 psig and the lixiviant also contained 15 grams per liter of sodium sulfate and 1 gram per liter of sodium chloride. The results of this leaching test are illustrated in FIG. 1 by curve 3. This test resulted in a uranium recovery only slightly lower than that obtained with the second test and again well above the recovery observed for the acid leaching run carried out without carbon dioxide. In a fourth test, the oxygen, carbon dioxide, sodium sulfate, and sodium chloride concentrations in the lixiviant were identical to those employed in the third test but the sulfuric acid concentration was reduced sharply to a value of 2 grams per liter. As shown by curve 4, this test still showed a significant improvement in uranium recovery over that attained without the use of carbon dioxide notwithstanding the much lower acid concentration and oxygen pressure.

Figure 2:
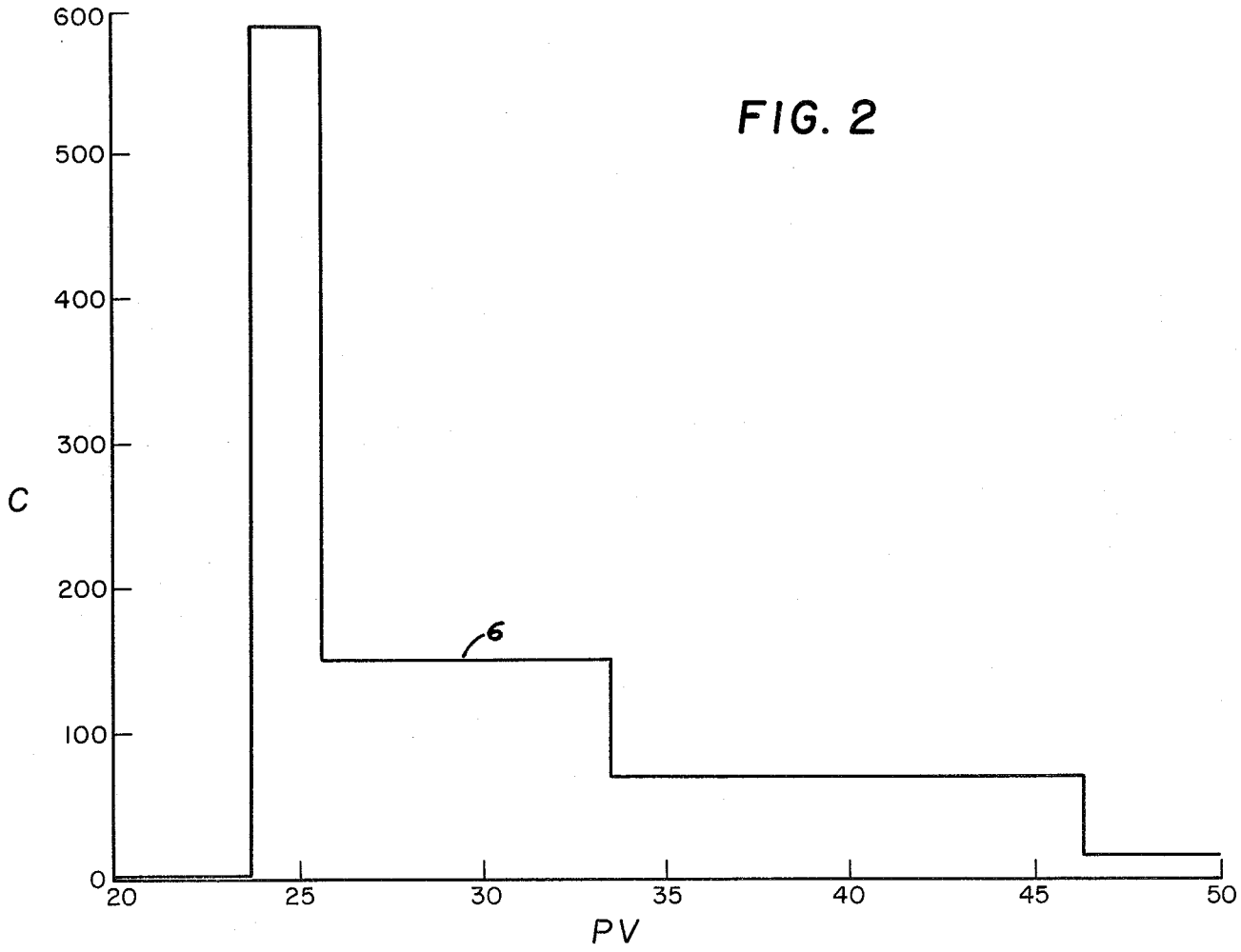
FIG. 2 is a graph illustrating the uranium concentration in a carbon dioxide-sulfuric acid lixiviant preceded by a carbon dioxide-free sulfuric acid solution.

In a fifth column test, the leaching procedure was initiated by the injection of sulfuric acid which was free of carbon dioxide. The sulfuric acid concentration was 4 grams per liter and the sulfuric acid solution was injected under an oxygen pressure of 150 psig. The sulfuric acid solution also contained sodium sulfate in a concentration of 74 grams per liter and sodium chloride in a concentration of 1 gram per liter. The injection of the carbon dioxide-free sulfuric acid system was continued for 15 pore volumes during which time essentially no uranium was recovered. After the injection of 15 pore volumes, the oxygen partial pressure was reduced to 100 psig and carbon dioxide was dissolved in the injected solution under a partial pressure of 50 psig. Shortly thereafter at about 16 pore volumes, small amounts of uranium averaging about 3 ppm $U_3O_8$ began to appear in the effluent and after passage of about 23 pore volumes of solution significant quantities of uranium began to appear. At 23 pore volumes, the oxygen partial pressure was increased to 500 psig and the carbon dioxide partial pressure to 300 psig. Shortly thereafter, the uranium concentration in the effluent increased dramatically and then declined due to depletion of uranium in the ore. The uranium concentration in the pregnant leachate is shown in FIG. 2 in which curve 6 is a graph of the uranium concentration, C, (presented as an average of several samples) in parts per million calculated as $U_3O_8$ on the ordinate versus the pore volume amount, PV, of solution passed through the pack on the abscissa. As can be seen from an examination of FIG. 2, the uranium concentration reached a maximum of about 590 ppm $U_3O_8$ at about 24 to 26 pore volumes and thereafter declined to average values of 151 ppm and 70 ppm for the next 8 and 13 pore volumes, respectively. The average uranium concentration for the remainder of the test (to 69 pore volumes) was 15 ppm. The results of this test are also illustrated by curve 7 in FIG. 1 in terms of the percent cumulative uranium recovery versus the pore volume amount of acid solution and acid-carbon dioxide lixiviant injected. As can be seen from an examination of curve 7, the initial injection of sulfuric acid and oxidizing agent results in most of the uranium being recovered in a highly concentrated lixiviant over a relatively short interval. This decreases the volume of lixiviant to be handled by the surface processing unit, thus lowering the uranium recovery cost.

As disclosed in the aforementioned application Ser. No. 36,627 by Espenscheid et al., the acid consumption rate increases with the acid concentration of the lixiviant. Thus, the acid concentration should be held down to the lowest value consistent with an acceptable leaching. The pH of the lixiviant may be as low as 1 (corresponding to a sulfuric acid concentration of near 2 percent), but normally will be limited to a value no greater than 1 weight percent and more desirably no greater than 0.5 weight percent. Preferably, the acid will be present in a concentration of at least 0.1 weight percent, corresponding to a pH of about 2. Somewhat lower acid levels may be employed but the pH of the injected lixiviant should not be allowed to exceed 2.5.

The preinjected acid employed in accordance with the present invention should similarly be a relatively dilute solution. Preferably, the sulfuric acid concentration in the initial slug is lower than the sulfuric acid concentration of the lixiviant. The preferred pH range of the initially injected acid is 2.0–3.0 as compared with a pH range of the lixiviant of 1.0–2.5.

Many refractory ores, such as the ore employed in the above-described experimental work, contain uranium associated with carbonaceous material. The carbonaceous material is present in intimate contact with the uranium mineral and retards access to the uranium by the lixiviant. A preferred application of the present invention is in leaching such deposits which contain the uranium associated with the carbonaceous material. While applicant's invention is not to be limited by theory, it is believed that the sulfuric acid functions to disrupt the carbonaceous material so that the uranium is exposed to the solubilizing action of the lixiviant. In most cases, the carbonaceous material will be present in the uranium deposit in an amount of at least 0.1 weight percent expressed as total organic carbon. The concentration may range up to about 2 weight percent expressed as total organic carbon.

The carbon dioxide in the lixiviant may be added in any suitable amount but normally will be present in a concentration of at least 0.05 weight percent (corresponding to a carbon dioxide partial pressure of about 6 psi.

Preferably, the carbon dioxide concentration is at least 0.1 weight percent corresponding to a carbon dioxide partial pressure of about 11 psi. At the pH level of the injected lixiviant, the carbon dioxide forms carbonic acid which is only slightly dissociated and equilibrated with the carbonate and bicarbonate ions. While a significant bicarbonate ion concentration is usually regarded as desirable and even necessary in the solubilization of uranyl carbonate complexes, it would appear that the use of carbon dioxide in the present invention results in carbonate complexing of the uranium. While this mechanism cannot be readily explained, it is noted that a pH transition zone exists within the formation at least during the early stages of the leaching process. In this regard, the pregnant lixiviant recovered in the above-described column tests remained relatively high, within the range of about 6.5 to 7.5, until most of the uranium was recovered. At about 60 percent uranium recovery in the case of the second and third tests and about 70 percent in the case of the fourth test, the pH then declined sharply reaching a value of less than 3 in the second and third tests and slightly more than 4 in the fourth test at the maximum uranium recovery. The maximum $CO_2$ pressure is dictated by the formation pressure and also the oxygen partial pressure where oxygen is used as the oxidizing agent. In most cases, however, the carbon dioxide pressure will not exceed 300 psi, equivalent to a carbon dioxide concentration in the lixiviant of 2.7 weight percent.

The initially injected acid solution is substantially free of carbon dioxide in order to avoid carbonate complexing of the uranium during the initial acid injection step. Some small quantities of carbon dioxide may be present, for example, as an impurity such as when air is used as the oxidizing agent, but even in that case the carbon dioxide concentration, if any, of the initially injected acid will be substantially less than the carbon dioxide concentration of the subsequently injected lixiviant.

The present invention may be carried out utilizing injection and production systems as defined by any suitable well arrangement. One well arrangement suitable for use in carrying out the invention is a five-spot pattern in which a central injection well is surrounded by four production wells. Other patterns such as seven-spot and nine-spot patterns also may be employed as well as the so-called "line flood" pattern in which injection and production wells are located in generally parallel rows. Typically the spacing between injection and production wells will be on the order of 50 to 200 feet. In some instances, particularly where the subterranean uranium deposit is of a limited areal extent, injection and production may be carried out through the same well. Thus, in relatively thick uranium deposits, dually completed injection-production wells of the type disclosed, for example, in U.S. Pat. No. 2,725,106 to Spearow may be employed. Alternatively, injection of fresh lixiviant and withdrawal of pregnant lixiviant through the same well may be accomplished by a "huff-and-puff" procedure employing a well system such as disclosed in U.S. Pat. No. 3,708,206 to Hard et al.

As noted previously, the initial sulfuric acid solution is injected into the deposit in the amount of at least 1 pore volume. By the term "pore volume" is meant that portion of the reservoir subject to the solubilizing action of the lixiviant. Where patterns of injection and production wells are employed, as described above, the pore volume may be considered as the pore volume of formation underlying the well patterns. Preferably, the amount of sulfuric acid injected is determined by monitoring one or more parameters of the produced effluent. Thus, the pH of the exhausted sulfuric acid solution may be monitored as it is produced from the production wells. Initially the exhausted sulfuric acid solution will have a pH of near neutral. Acid injection may be continued until the pH of the produced solution declines to a value of less than 6.5, normally within the range of 5 to 6, and thereafter injection of the lixiviant is initiated. Also, the uranium concentration level of the exhausted acid may be monitored. Initially the uranium in the exhausted acid will be in a low concentration. During this stage of the operation, the produced solution can be recycled to the injection system, bypassing the ion exchange column or other means employed for uranium extraction. During the recycling procedure, additional sulfuric acid and oxidant can be added to the solution to formulate fresh acid solution for injection. This procedure may be continued until the uranium concentration in the exhausted acid reaches a desired level of at least 5 parts per million $U_3O_8$, typically within the range of 10 to 20 parts per million, and thereafter $CO_2$ may be added to formulate the lixiviant.

The oxidizing agent used in the initially injected acid solution may be the same or different than that used in the lixiviant. Usually, however, it will be preferred to employ elemental oxygen although other strong oxidizing agents such as hydrogen peroxide may also be used. Usually the concentration of the oxidizing agent in the initially injected acid solution will be the same as that in the lixiviant. Typically, where oxygen is used, the oxygen pressure on the acid solution and the lixiviant may range from about 25 to 2000 psia.

I claim:

1. In a method for the recovery of uranium from a subterranean uranium-containing deposit penetrated by injection and production systems wherein an aqueous lixiviant containing an oxidizing agent, sulfuric acid, and carbon dioxide is introduced into said deposit via said injection system and displaced through said deposit to solubilize uranium therein and thereafter recovered from said deposit via said production system, the improvement comprising prior to the injection of said lixiviant injecting an aqueous solution of sulfuric acid and oxidizing agent which is substantially free of carbon dioxide into said deposit in an amount of at least one pore volume.

2. The method of claim 1 wherein said preinjected aqueous solution of sulfuric acid and oxidizing agent has a lower sulfuric acid concentration than the sulfuric acid concentration of said lixiviant.

3. The method of claim 2 wherein said preinjected aqueous solution of sulfuric acid has a pH within the range of 2.0–3.0 and said lixiviant has a pH within the range of 1.0–2.5.

4. The method of claim 1 further comprising the step of producing said preinjected sulfuric acid solution from said production system, monitoring the pH of said produced solution, and after the pH of said produced solution declines to a value less than 6.5 initiating the injection of said lixiviant.

5. The method of claim 1 further comprising producing said acid solution from said production system, monitoring the uranium concentration of said produced acid solution, and initiating the injection of said lixiviant after the uranium concentration of said produced acid solution reaches a level of at least 5 parts per million $U_3O_8$.

6. The method of claim 1 wherein said subterranean deposit contains uranium associated with carbonaceous material.

7. The method of claim 1 wherein the concentration of carbon dioxide in said lixiviant is at least 0.05 weight percent.

* * * * *

UNITED STATES PATENT AND TRADEMARK OFFICE

CERTIFICATE OF CORRECTION

PATENT NO. : 4,337,979

DATED : July 6, 1982

INVENTOR(S) : Tsoung-Yuan Yan

It is certified that error appears in the above—identified patent and that said Letters Patent is hereby corrected as shown below:

Column 2, line 34, "containing" should be -- contain --.

Column 4, Line 1, "1.193" should be -- 1.93 --.

Signed and Sealed this

*Eighth* Day of *March 1983*

[SEAL]

*Attest:*

GERALD J. MOSSINGHOFF

*Attesting Officer*

*Commissioner of Patents and Trademarks*